US007140214B2

(12) United States Patent
Lindstrom

(10) Patent No.: US 7,140,214 B2
(45) Date of Patent: Nov. 28, 2006

(54) ELECTRO-MECHANICAL CYLINDER LOCK-KEY COMBINATION WITH OPTICAL CODE

(75) Inventor: Erik Lindstrom, Virum (DK)

(73) Assignee: Ruko A/S, Herlev (DK)

( * ) Notice: Subject to any disclaimer, the term of this patent is extended or adjusted under 35 U.S.C. 154(b) by 0 days.

(21) Appl. No.: 10/512,647

(22) PCT Filed: Apr. 2, 2003

(86) PCT No.: PCT/EP03/03464

§ 371 (c)(1),
(2), (4) Date: Oct. 27, 2004

(87) PCT Pub. No.: WO03/085227

PCT Pub. Date: Oct. 16, 2003

(65) Prior Publication Data

US 2005/0235714 A1 Oct. 27, 2005

(30) Foreign Application Priority Data

Apr. 11, 2002 (DK) ..... 2002 00538

(51) Int. Cl.
*E05B 47/06* (2006.01)

(52) U.S. Cl. ..... 70/278.3; 70/278.7; 70/389; 70/427

(58) Field of Classification Search ..... 70/423, 70/427, 455, 491, 389, 421, 419, 495, 278.2, 70/278.3, 278.7, 279.1, 283.1, 390
See application file for complete search history.

(56) References Cited

U.S. PATENT DOCUMENTS 2,008,150 A * 7/1935 Nelson ..... 70/277
3,733,862 A * 5/1973 Killmeyer ..... 70/277
3,820,364 A * 6/1974 Greeley ..... 70/419
3,889,501 A * 6/1975 Fort ..... 70/283
4,277,962 A * 7/1981 Lipschutz ..... 70/423
4,732,022 A * 3/1988 Oliver ..... 70/406
4,848,115 A * 7/1989 Clarkson et al. ..... 70/276
4,866,962 A * 9/1989 Aston et al. ..... 70/277
5,245,329 A * 9/1993 Gokcebay ..... 340/5.33
5,543,665 A 8/1996 Demarco
5,691,711 A * 11/1997 Jorgensen ..... 340/5.67
5,745,045 A 4/1998 Kulha et al.
5,823,029 A * 10/1998 Eden et al. ..... 70/358

(Continued)

FOREIGN PATENT DOCUMENTS

DE 4327381 A1 2/1995

(Continued)

*Primary Examiner*—Lloyd A. Gall
(74) *Attorney, Agent, or Firm*—Sughrue Mion, PLLC

(57) ABSTRACT

An electromechanical cylinder lock-key combination includes a cylinder housing and a cylinder core rotatably arranged in the cylinder housing and having a key-way for receiving a key. A plurality of key actuated moveable blocking elements block the rotation of the cylinder core unless a correct key is inserted in the key-way. An optical code reader in the lock reads an optical code element provided on an inserted key. At least one of said blocking elements functions as a bar element barring insertion of the key into the key-way unless a correct optical code element is provided on the key. By using at least one of the mechanical elements already present in the lock as part of the electronically controlled blocking mechanism, in combination with the use of an optical code requiring no moveable parts for the reading thereof, space requirements in the lock device are kept to a minimum.

14 Claims, 5 Drawing Sheets

U.S. PATENT DOCUMENTS

| | | | | |
|---|---|---|---|---|
| 6,169,650 | B1 * | 1/2001 | Albrecht | 361/171 |
| 6,318,137 | B1 * | 11/2001 | Chaum | 70/278.3 |
| 6,363,762 | B1 * | 4/2002 | Kueng | 70/278.3 |
| 6,526,791 | B1 * | 3/2003 | Shvarts | 70/419 |
| 6,840,072 | B1 * | 1/2005 | Russell et al. | 70/278.3 |
| 6,945,082 | B1 * | 9/2005 | Field et al. | 70/409 |

FOREIGN PATENT DOCUMENTS

| | | | |
|---|---|---|---|
| EP | 0424356 | A1 | 4/1991 |
| EP | 0623722 | A1 | 11/1994 |
| EP | 0666393 | A1 | 8/1995 |
| EP | 0 882 858 | A | 12/1998 |
| FR | 2 801 334 | A | 5/2001 |
| GB | 2 183 717 | A | 6/1987 |
| GB | 2 190 421 | A | 11/1987 |
| GB | 2 208 678 | A | 4/1989 |

* cited by examiner

ELECTRO-MECHANICAL CYLINDER LOCK-KEY COMBINATION WITH OPTICAL CODE

FIELD OF INVENTION

The present invention relates generally to electro-mechanical key and lock devices and more particularly to an electro-mechanical cylinder lock-key combination using an optical code, such as a holographic code or a bar code provided on the key.

BACKGROUND

It is previously known a variety of lock devices that make use of electronically controlled elements for increasing the security of the lock. However, the demand for lock systems with a high level of security is constantly increasing.

Many prior art electro-mechanical lock devices rely on a power source external to the lock device for powering the electronic circuitry of the device. This poses a problem, particularly when fitting a new electro-mechanical lock in an existing installation.

One way to avoid this problem is to provide a replaceable battery either in the lock device or in the keys used with the lock device. However, the replacement of the battery is often a cumbersome operation. Furthermore, the battery takes up valuable space, irrespectively of whether it is provided in the lock or in the key. Also, batteries constitute an environmental hazard.

Another problem with today's electro-mechanical lock devices is that they must include not only mechanical locking elements but also the electronic circuitry and elements controlled by the electronic circuitry. All these elements must fit into the space defined for conventional all mechanical locks. The size of the electronic part of the locking mechanism must therefore be kept to a minimum.

Yet another problem with prior art electro-mechanical lock devices is that when the key having correct mechanical code is inserted then all key-actuated moveable blocking elements are moved to non-blocking position; only the electro-mechanical blocking element remains to prevent the rotation of the cylinder core.

SUMMARY OF THE INVENTION

An object of the present invention is to provide a key and lock device of the kind initially mentioned, wherein a high degree of security is obtained while the space requirements are kept to a minimum.

The invention is based on the realisation that the movement of at least one of the blocking elements conventionally found in a mechanical lock can be prevented by the provision of an optical code element on the key.

According to the invention there is provided an electro-mechanical cylinder lock-key combination as defined in the appended claims.

By using at least one of the mechanical elements already present in the lock as part of the electronically controlled blocking mechanism, in combination with the use of an optical code requiring no moveable parts for the reading thereof, space requirements in the lock device are kept to a minimum.

In a preferred embodiment, the optical code element is provided in the form of a hologram. This provides for a very high level of security thanks to the huge amount of possible codes and the difficulty in copying the key.

In another embodiment, a reflective bar code is provided as optical code on the key.

Further preferred embodiments are defined by the dependent claims.

BRIEF DESCRIPTION OF DRAWINGS

The invention is now described, by way of example, with reference to the accompanying drawings, in which.

DETAILED DESCRIPTION OF THE INVENTION

In the following a detailed description of preferred embodiments of the present invention will be given.

Figure 1:
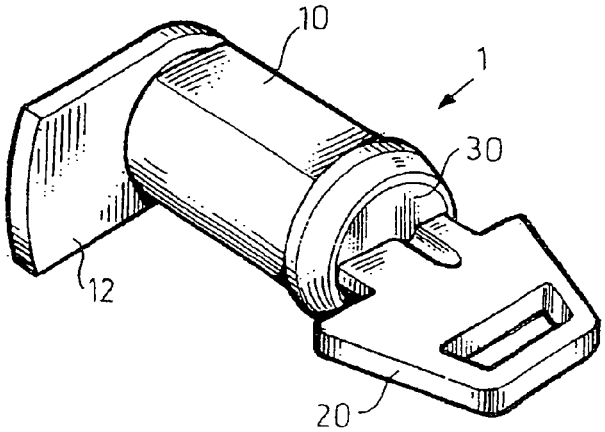
FIG. 1 is an overall perspective view of a key and lock device according to the invention.

In FIG. 1, an overall perspective view of an electro mechanical cylinder lock-key combination 1 according to the invention is shown. The combination comprises a generally cylindrical cylinder housing 10 and a key 20 inserted into a key-way of a cylinder core 30 rotatably provided in the cylinder housing. By means of rotation of the key, a campiece 12 is actuated so as to act on a follower of a lock device. The cylinder housing 10 has the same general shape as conventional cylinder housings and the lock cylinder according to the invention can thus replace already installed all-mechanical lock cylinders.

Figure 2:
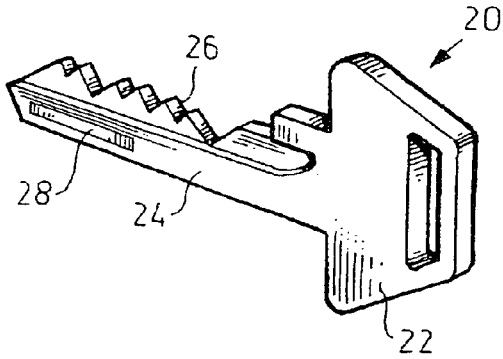
FIG. 2 is a perspective view of a key according to the invention.

The key 20 is shown in its entirety in FIG. 2. It has a conventional shape and comprises a grip portion 22 and a bit portion 24. The bit portion has an upper code surface 26 arranged to cooperate with tumbler pins provided in the lock cylinder.

On a side surface of the bit portion there is provided an elongated holographic image or hologram 28 having a surface being essentially flush with the side surface of the bit portion so as not to interfere with the insertion of the key into the cylinder core 30. The hologram functions as an additional code and a key must thus have both a correct mechanical code, i.e., code surface 26, and optical code, i.e., hologram 28. This adds a further level of security as compared to an all-mechanical lock.

Figure 3:
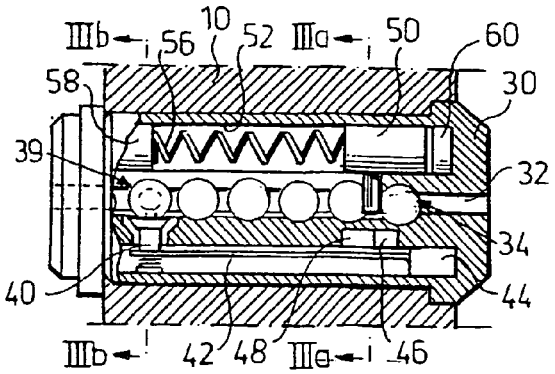
FIG. 3 is a top sectional view of the device shown in FIG. 1 before insertion of a key.
Figure 3A:
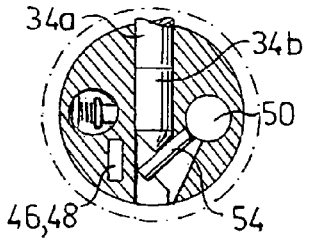
FIGS. 3*a* and 3*b* are cross-sectional views of the device shown in FIG. 3 taken along the lines IIIa—IIIa and IIIb—IIIb, respectively, in FIG. 3.

A top sectional view of the lock cylinder is shown in FIG. 3, wherein it is seen how the elongated cylinder core 30 is provided in the cylinder housing 10. A key-way 32 is provided centrally in the cylinder core so as to receive the key 20. Centrally aligned in the cylinder core are also six pin tumbler chambers 34–39, wherein the five front chambers 34–38 each contains conventional pin tumblers acting as blocking elements when a key having incorrect mechanical code is inserted in the cylinder. An example of pin tumbler is given in FIG. 3*a*, showing a top pin 34*a* and a bottom pin 34*b*.

Figure 3B:
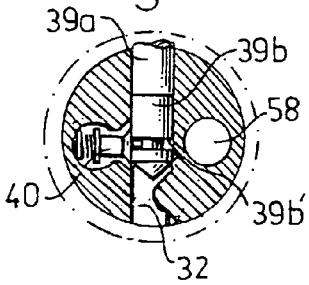

The inner pin tumbler chamber 39 contains a conventional top pin 39*a* and a special kind of bottom pin, designated 39*b* in FIG. 3*b*. This pin is provided with a circumferential waist or indent 39*b*' arranged to receive an outer portion of a pin-blocking element 40 provided at the outer end of a piezo-electric bender 42. This bender is arranged to move the pin blocking element 40 into and out of engagement with the waist portion 39*b*' of the special pin 39*b*. This function will be further explained below.

The inner end of the piezo-electric bender 42 is fixed so as to make the outer end move when current flows through the piezo-electric bender.

By using the inner pin tumbler as electronically controlled blocking element, several advantages are obtained. Firstly, the time from when the key 20 enters the cylinder core 30 to when it contacts the inner pin tumbler is long enough for the electronics to process the information in the optical code and control the pin tumbler 39*a*, 39*b* accordingly. Secondly, the piezo-electric bender 42 can be made long enough so as to displace the pin-blocking element 40 out of engagement with the special pin tumbler.

The electrical operation of the lock cylinder is controlled by means of an application specific integrated circuit (ASIC) 44. This ASIC is electrically connected to an optical unit comprising a laser diode 46 and an array of opto-electronic sensors 48 for recording an incoming laser beam. This will be fully described below with reference to FIG. 4.

On the opposite side of the key-way from the opto-electronic components there is provided a striking pin or "hammer" 50 running in a cylindrical cavity 52 in the cylinder core 30. The hammer is provided with a finger 54 arranged to cooperate with the tip of the key 20 during insertion thereof and is spring-biased towards the front end of the cylinder core 30 by means of a helical spring 56.

Figure 7:
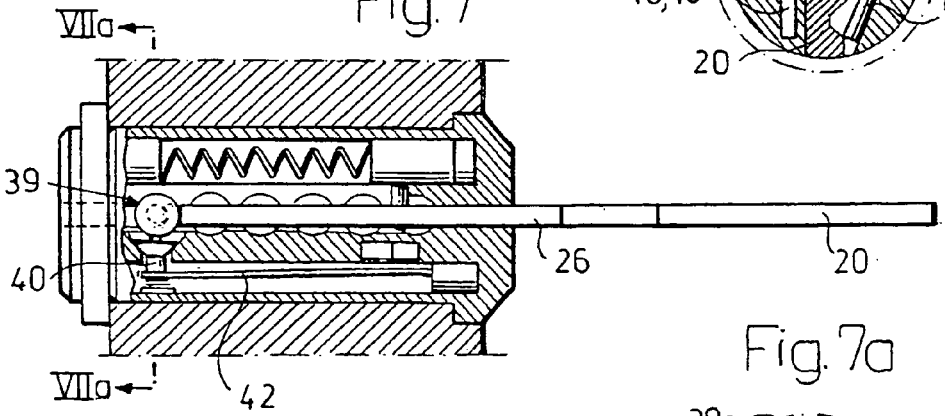
Figure 7A:
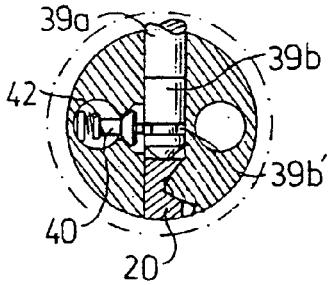

An electric capacitor 58 is connected to the electrical power consuming components of the lock cylinder and is provided for storing electric energy by these components. Finally there is provided a piezo-electric generator 60 in the cavity 52. The generator comprises piezo-electric ceramic, i.e., a material made of crystalline substance, which creates charges of electricity by the application of pressure and vice versa. The generator functions in the following way. In its resting position shown in FIG. 3, the hammer 50 is pressed against the generator 60 by means of the force exerted by the helical spring 56. When the hammer is moved from this position by the key tip, se FIG. 4, this force is removed and the generator 60 thus produces a weak electric current, which is supplied to the ASIC 44 and the laser diode 46. The current thus functions as a "wake up signal" for the ASIC, which is essentially powered by the capacitor 58. When the hammer is returned to its original position, as will be described below with reference to FIG. 7, mechanical energy is again converted into electric energy, charging the capacitor 58.

If so desired, the helical spring 56 can be given a characteristics adapted to provide defined force on the hammer.

Figure 4:
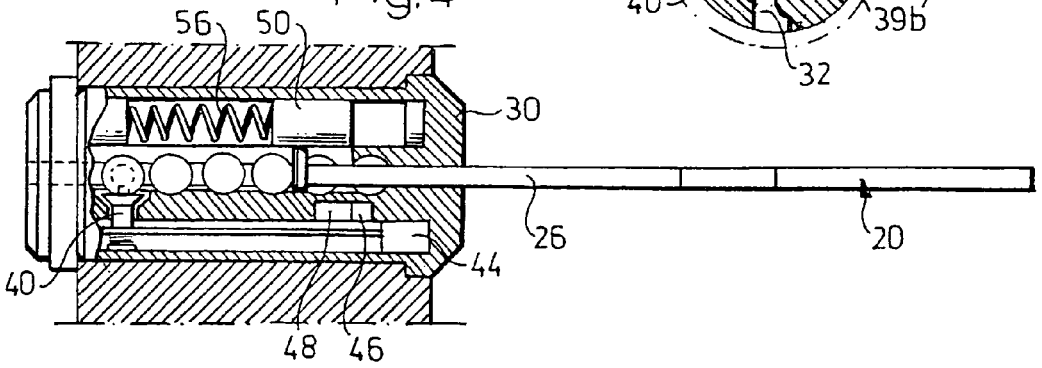
FIGS. 4–7 are top sectional views of the device shown in, FIG. 1 during different stages of insertion of a key.

The operation of the lock cylinder will now be explained. In FIG. 4 there is shown how the key is inserted into the key-way. The hammer 50 is moved from its resting position shown in FIG. 3 when the tip of the key bit reaches the finger 54 thereof. The electric energy thus created by the generator 60 is directed to the ASIC 44, thereby making it operative. The laser diode 46 is then controlled by the ASIC to emit a laser beam in the direction of the side of the key bit provided with the hologram containing the holographic code. During insertion of the key 20, the hologram breaks up this laser beam in between 1 and 32 sub-beams and these are reflected onto the opto-electronic sensors 48 in dependence of the holographic code. In other words, during insertion of the key 20 the 32 bit optical code contained in the hologram is recorded by the sensors 48 and this code is transmitted to the ASIC 44.

By reading the optical code while the key is moving, valuable time is saved and the user inserting the key into the lock cylinder will experience no time delays for reading and evaluating the optical code.

The correct optical code of the cylinder is stored in the ASIC. This correct code is compared with the code recorded by the sensors 48 and if they are identical, then the laser diode 46 is switched off and the pin-blocking element 40 is moved to a non-blocking position, as will be explained below. If the codes differ from each other, the laser diode is still switched off but the pin-blocking element 40 is left in blocking position.

Figure 5:
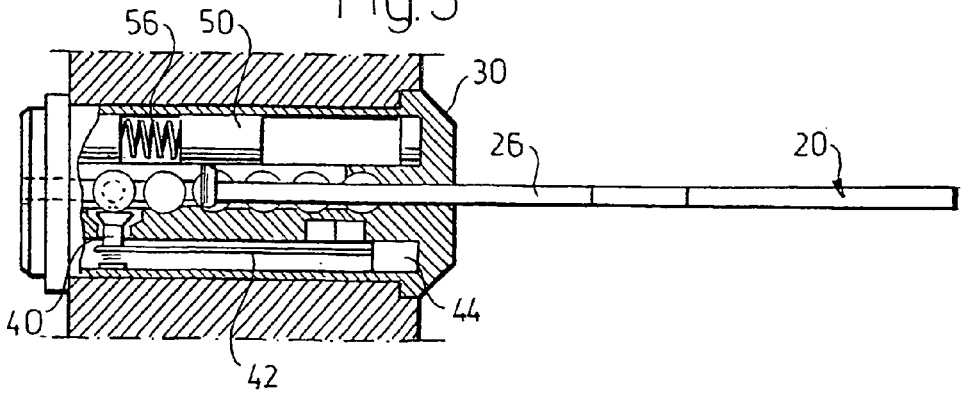
Figure 6:
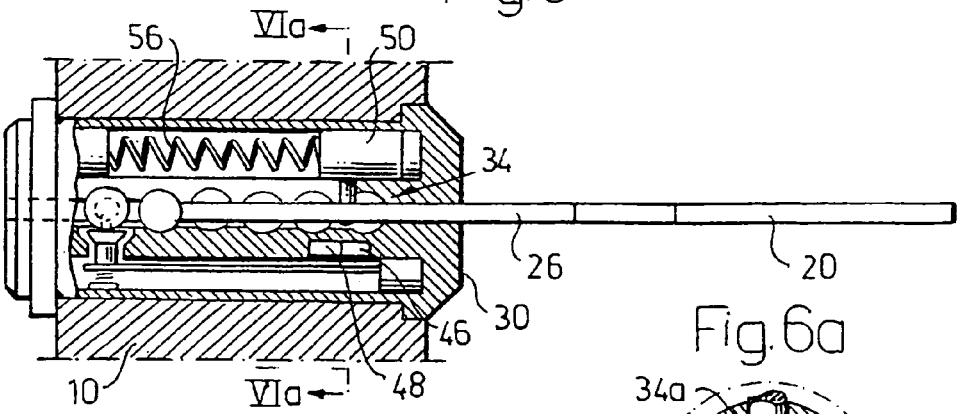
Figure 6A:
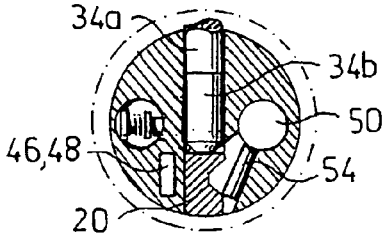
FIGS. 6*a* and 7*a* are cross-sectional views taken along line VIa—VIa in FIG. 6 and line VIIa—VIIa in FIG. 7, respectively.

In FIG. 5 there is shown how the key 20 has been inserted further into the cylinder core 30, bringing the hammer 50 with it, compressing the helical spring 56. When the helical spring is compressed further, the force exerted by it on the hammer makes the finger 54 of the hammer 50 slip off the key tip and take the position shown in FIG. 6*a*. During this operation, the entire hammer 50 is turned. The spring force from the helical spring 56 then returns the hammer to its original position shown in FIG. 3.

Figure 10:
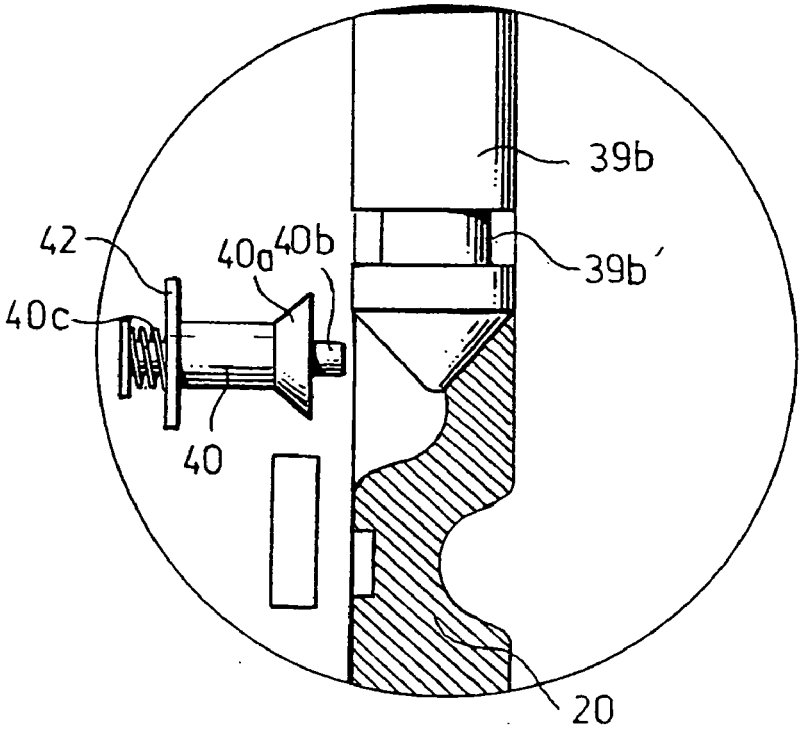
FIGS. 10 and 11 are cross-sectional views of the device according to the invention showing the interaction between a special pin tumbler and a pin blocking element.

If the key 20 inserted into the cylinder has a correct optical code, the ASIC connects the generator 60 and the piezo-electric bender 40. When the hammer is released and hits the piezo-electric generator, the generator generates a voltage, which is directed across the piezo-electric bender 42. The generator 60 and the bender 42 thereby form a matched electrical circuit, providing a reliable actuator. The voltage across the piezo-electric bender makes it bend and thereby moves the pin blocking element 40 out of engagement with the special blocking pin 39*b*. With the pin blocking element in this position, the pins 39*a*, 39*b* function as the ordinary pins 34*a,b*–38*a,b*. Thus, the tip of the key 20 pushes the pins 39*a,b* upward, see FIG. 10, and the key can be fully inserted into the cylinder core to the position shown in FIG. 8. If the mechanical key code 26 provided on the key is correct, then all pin tumblers have been moved to a position wherein the shear line between top and bottom pins is aligned with the shear line between the cylinder housing 10 and the cylinder core 30. This enables rotation of the cylinder core 30 and thereby unlocking of the lock provided with the lock cylinder 1.

Figure 8:
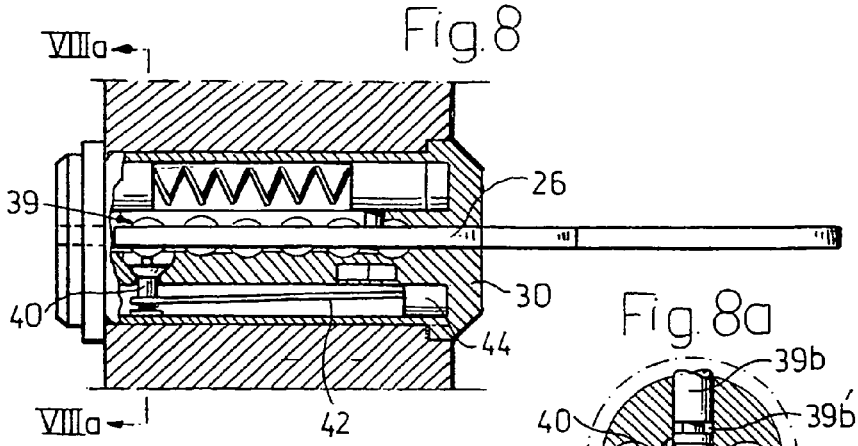
FIG. 8 is a top sectional view of the device shown in FIG. 1 with a fully inserted key.
Figure 8A:
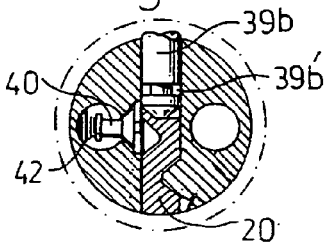
FIG. 8*a* is a cross-sectional view of the device shown in FIG. 8 taken along the line VIIIa—VIIIa in FIG. 8.

When a correct key is withdrawn from the position shown in FIG. 8, the piezo-electric bender is returned to its straight shape.

Figure 11:
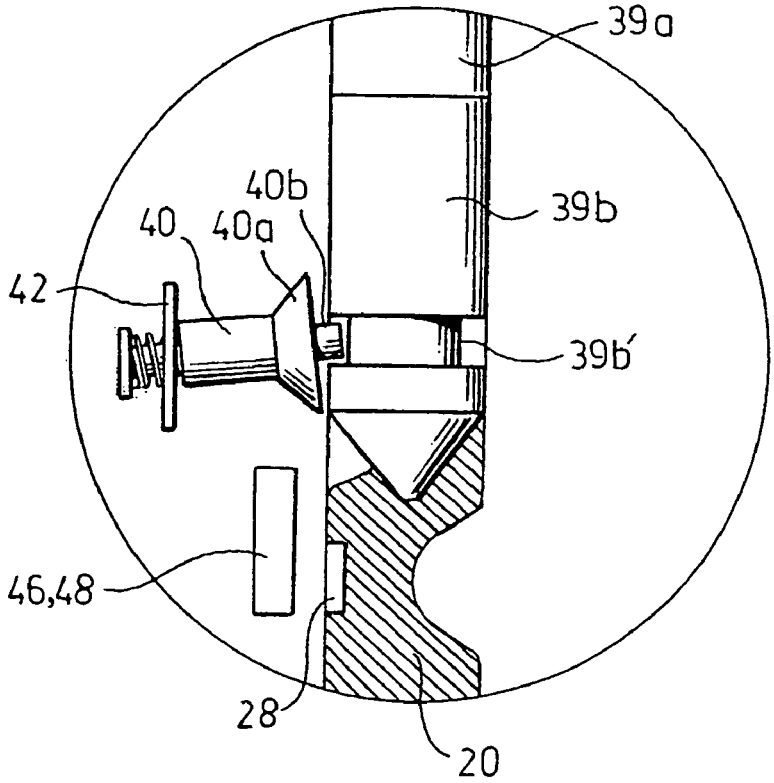

If the optical code provided on the key is incorrect, the pin blocking element remains in engagement with the special pin 39*b* and the special pin tumbler 39*a,b* is stuck in position, see FIG. 11. This in turn prevents the key 20 from being fully inserted into the cylinder core and it can only be inserted to the position shown in FIGS. 9 and 9*b*.

Figure 9B:
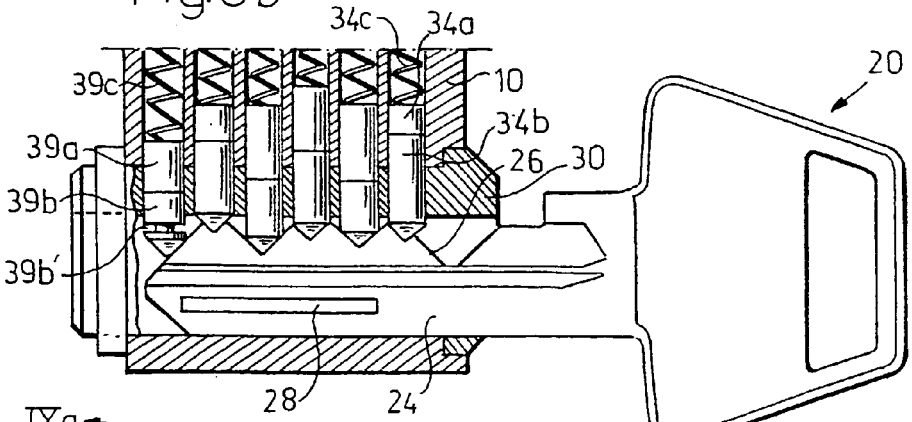
FIG. 9*b* is a sectional side view showing the position of an inserted key.
Figure 9:
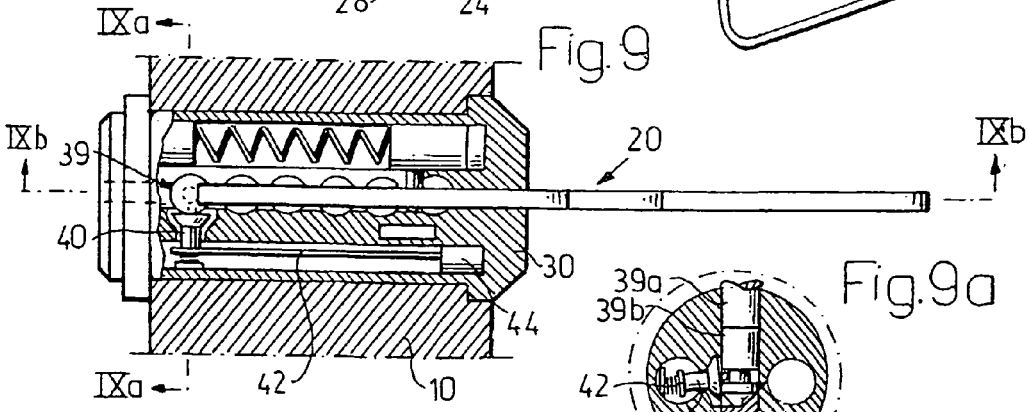
FIG. 9 is a top sectional view of the device shown in FIG. 1 with an inserted key having incorrect optical code.

As appears from FIG. 9*b*, in this position of the key, not only the pin tumbler 39*a, b* that is controlled by the optical code but also all other pin tumblers block rotation of the cylinder core. This is a significant advantage, as a key provided with correct mechanical code but with incorrect optical code releases no blocking elements in the lock cylinder.

The pin-blocking element 40 is shown in detail in FIG. 11 in the position wherein a user of a key having incorrect optical code tries to push the key to its fully inserted position. The pin-blocking element is attached to the piezo-electric bender 42 through an aperture therethrough and is provided with a tapering flange 40*a* in the direction of the pin 39*b*. Its outer portion ends in a tip 40*b* dimensioned so as to fit into the waist portion 39*b*' of the special pin 39*b*. The pin-blocking element 40 is normally kept level by means of the spring force provided by a helical spring 40*c*.

Figure 9A:
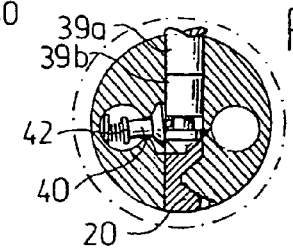
FIG. 9*a* is a cross-sectional view of the device shown in FIG. 9 taken along the line IXa—IXa in FIG. 9.

Returning to FIG. 9*a*, if a user of a key lacking correct optical code urges the key to the special blocking pin 39*b*, this pin is moved slightly upward to an extent allowed by the tilt of the pin blocking element 40. In the position shown in FIGS. 9*a* and 11, the flange 40*a* cooperating with the cylinder core material provides a self-locking arrangement, pressing the pin-locking element towards the special blocking pin 39*b*. This provides a mechanical arrangement adapted to withstand the forces from a hammer hitting the key grip, for example.

By using piezo-electronic components, large movable masses in the electronically actuated lock mechanism are avoided, increasing the speed by which the unlocking can be effected and saving space.

Figure 12:
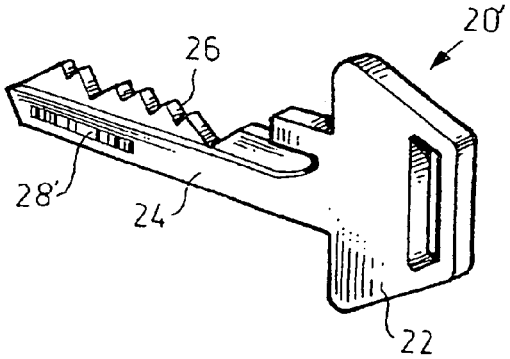
FIG. 12 is a perspective view of an alternative key according to the invention.

A preferred embodiment of an electromechanical cylinder lock-key combination and a key according to the invention has been described. The person skilled in the art realises that this could be varied within the scope of the appended claims. Thus, although a hologram has been described as the preferred optical code element, it will be appreciated that other forms of code elements could be used as well. An example of an alternative embodiment is given in FIG. 12, wherein a reflective bar code 28' is provided on the side surface of the bit portion. If this kind of optical code is used, the above described laser diode 46 is replaced by a conventional light emitting diode (LED).

Alternatively, the optical code could be provided not on the side surface of the key bit but on the underside thereof.

In its preferred embodiment, the inventive lock cylinder is provided with a special blocking pin tumbler arranged to be released by a piezo-electric bender upon detection of a correct optical code. The piezo-electric bender could of course be replaced by another kind of actuator, such as a solenoid etc.

A lock cylinder having six pin tumblers has been described. It will be realised that a cylinder having a different configuration than the embodiment shown can be used without departing from the inventive concept.

By providing a piezo-electric generator, the battery found in many electromagnetic locks is dispensed with. However, the inventive idea is also applicable to a lock having an internal battery or being externally powered.

In the preferred embodiment, the inner pin tumbler is used as the electronically blocked element. However, other pin tumblers can be blocked either in addition to or instead of the inner pin tumbler.

The electronic lock mechanism has been shown controlled by means of an ASIC. Any micro controller or other processing unit can of course be used for that purpose.

The invention claimed is:

1. An electromechanical cylinder lock-key combination, comprising:

a housing having a bore;

a core rotatably arranged in said bore and having a key-way for receiving a key having a grip portion and a bit portion;

a plurality of key actuated moveable blocking elements for blocking the rotation of said core relatively to said housing unless a correct key is inserted in said key-way;

an electronic processing unit;

an optical code element provided on said bit portion of said key;

an optical code reader provided in said lock;

characterized by a bar element comprising at least one of said key actuated moveable blocking elements, said bar element barring insertion of said key into said key-way when movement of said bar element is prevented, an electronically controlled latch element moveable between a latching position, wherein movement of said bar element is prevented by said latching element, and a releasing position, wherein movement of said bar element is allowed by said latching element, and a means for moving said latch element to said releasing position upon detection by said optical code reader of a correct optical code element on said key.

2. The combination according to claim 1, wherein said optical code element is a holographic image.

3. The combination according to claim 2, wherein said holographic image is provided with a surface essentially flush with a surface of said bit portion of said key.

4. The combination according to claim 2, wherein said optical code reader comprises a laser diode and an optical sensor.

5. The combination according to claim 1, wherein said optical code element comprises a bar code.

6. The combination according to claim 5, wherein said optical code reader comprises a light emitting diode and an optical sensor.

7. The combination according to claim 2, wherein said bar element is a pin having an indent for receiving a portion of said latch element.

8. The combination according to claim 7, wherein said latch element is provided on a bendable element.

9. The combination according to claim 8, wherein said bendable element is a piezo-electric bender.

10. The combination according to claim 2, wherein said latch element is provided with a tapering flange arranged to urge said latch element towards said bar element when inserting a key having an incorrect optical code element.

11. The combination according to claim 2, wherein said bar element is part of an inner pin tumbler.

12. The combination according to claim 1, comprising a piezoelectric electric generator arranged to convert mechanical power generated by inserting said key into said core to electrical power.

13. The combination according to claim 12, comprising a spring biased striking pin moveable by means of said key to and from a position, wherein it exerts a force on said piezo-electric generator.

14. The combination according to claim 12, comprising a bendable element on which said latch element is provided, and means for supplying electric power generated by said piezo-electric generator to said bendable element so as to move said electronically controlled latch element to its releasing position upon detection of correct optical code element.

* * * * *